US007475693B2

(12) United States Patent
de Laforcade

(10) Patent No.: US 7,475,693 B2
(45) Date of Patent: Jan. 13, 2009

(54) DEVICE FOR ROLLING UP A LOCK OF HAIR

(75) Inventor: Vincent de Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 347 days.

(21) Appl. No.: 11/137,452

(22) Filed: May 26, 2005

(65) Prior Publication Data

US 2005/0263168 A1 Dec. 1, 2005

Related U.S. Application Data

(60) Provisional application No. 60/579,241, filed on Jun. 15, 2004.

(30) Foreign Application Priority Data

May 27, 2004 (FR) ..... 04 51046

(51) Int. Cl.
*A45D 6/04* (2006.01)

(52) U.S. Cl. ..... 132/266

(58) Field of Classification Search ..... 132/266, 132/245, 246–250, 265–267, 253, 237–242; D28/26; 242/339, 573, 573.9
See application file for complete search history.

(56) References Cited

U.S. PATENT DOCUMENTS

| | | | | | |
|---|---|---|---|---|---|
| 2,077,198 | A | * | 4/1937 | Anderson | 132/266 |
| 2,905,186 | A | * | 9/1959 | Pfalzgraf | 132/266 |
| 3,623,491 | A | * | 11/1971 | Garrett | 132/245 |
| 3,631,868 | A | | 1/1972 | Solomon | |
| 5,212,366 | A | * | 5/1993 | McDougall | 219/222 |
| 5,263,501 | A | * | 11/1993 | Maznik | 132/211 |

FOREIGN PATENT DOCUMENTS

| | | | |
|---|---|---|---|
| FR | 1 279 457 | A | 11/1961 |
| WO | WO 2004/032666 | A1 | 4/2004 |

* cited by examiner

*Primary Examiner*—Robyn Doan
*Assistant Examiner*—Rachel A Running
(74) *Attorney, Agent, or Firm*—Oliff & Berridge, PLC

(57) ABSTRACT

The present invention relates to a device for rolling a lock of hair, the device comprising: a deformable curler extending along a longitudinal axis, capable of taking up a first configuration enabling the lock of hair to be rolled up on the curler, and a second configuration in which at least a fraction of the length of the curler presents a radial dimension that is smaller than in the first configuration so as to facilitate extraction of the curler from the lock that has been rolled up in this way; and a control member enabling the curler to be changed from the first configuration to the second configuration.

34 Claims, 3 Drawing Sheets

FIG.4
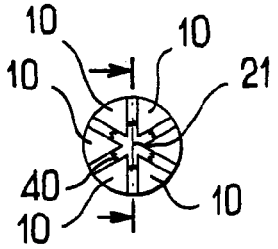
FIG.6
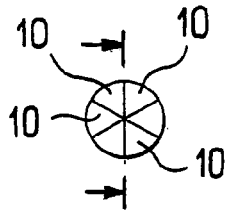
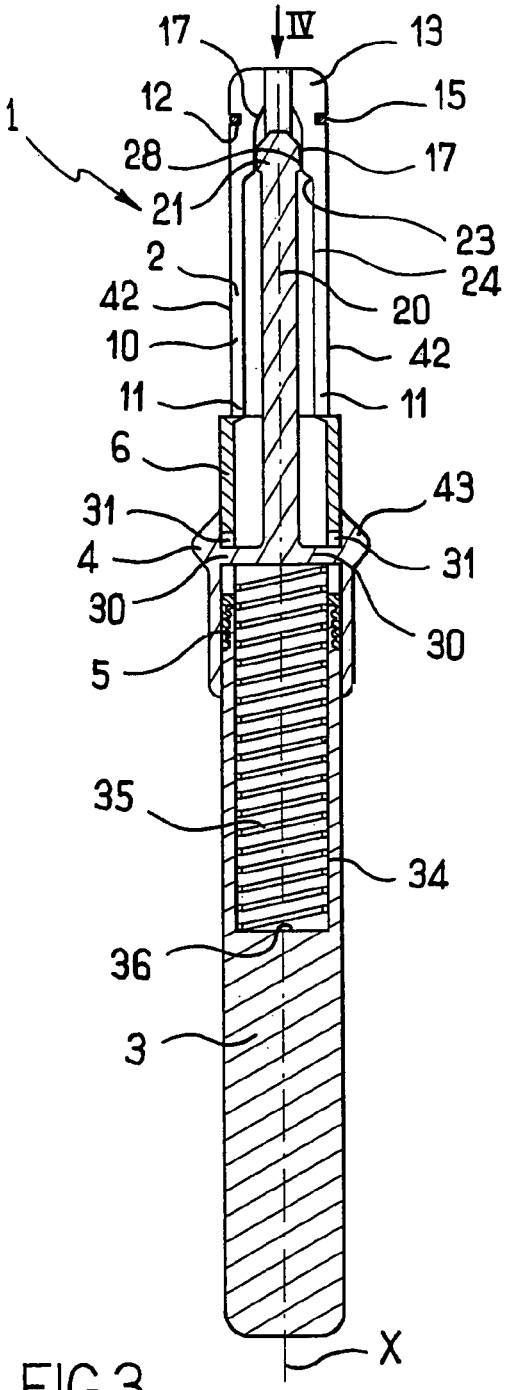
FIG.3
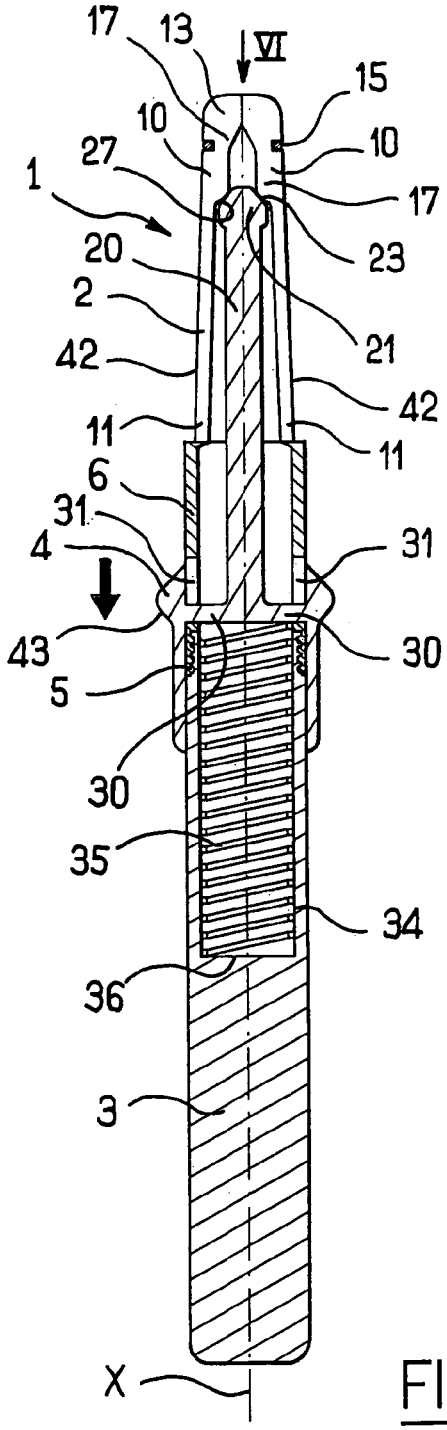
FIG.5

DEVICE FOR ROLLING UP A LOCK OF HAIR

This non-provisional application claims the benefit of French Application No. 04 51046 filed on May 27, 2004, and U.S. Provisional Application No. 60/579,241 filed on Jun. 15, 2004, the entire disclosures of which are incorporated herein by reference.

BACKGROUND

The present invention relates to treating at least one lock of hair, for example, to implement a permanent wave.

Permanent waves are based on the principle of deforming hair under the action of a chemical substance while the hair is being subjected to mechanical tension. This tension may be produced, for example, by rolling up the hair around a curler.

As a general rule, locks of hair are rolled up on a relatively large number of curlers that are distributed more or less uniformly over a head of hair, which takes time, requires some degree of skill, and a great deal of equipment.

SUMMARY

There exists a need to reduce the amount of equipment used for such treatments.

Various exemplary embodiments of the invention satisfy this need by providing a device for rolling up a lock of hair, the device comprising: a deformable curler extending along a longitudinal axis, arranged to take up a first configuration that enables the lock of hair to be rolled up on the curler, and a second configuration that facilitates extraction of the curler from the lock of hair rolled up on the curler in the first configuration; and a control member arranged to change the curler from the first configuration to the second configuration.

In the second configuration, the curler may advantageously have a radial dimension, over at least a fraction of a length thereof, that is smaller than in the first configuration. For example, the smaller radial dimension may be in a part of the curler that is not a central region of the curler, for example, a part close to a free end. Such an arrangement may make it easier to extract the curler.

In various exemplary embodiments of the invention, the device may easily be removed from the lock of hair after a permanent wave substance has been applied thereto. This may be advantageous, for example, when the applied substance acts quickly on hair. The time required for making a permanent wave may thus be shortened.

In exemplary embodiments, the device may include a handle member to which the curler is connected. For example, the curler may be releasably connected to the handle member and the handle member and the curler may co-operate with each other by screw-fastening, for example.

In exemplary embodiments, the control member may be movable relative to the curler, being movable relative thereto along the longitudinal axis of the curler, for example.

For example, the control member may comprise a sliding ring, which may advantageously include an outwardly-directed portion in relief making it easier for the user to move the control member.

In exemplary embodiments, the curler may include a plurality of blades, which may be elastically deformable, for example, being interconnected at proximal ends thereof. All of the blades may be molded together as a single piece, for example.

In exemplary embodiments, at least one blade may include an enlarged portion in a vicinity of a distal end thereof, the enlarged portion projecting inward. Preferably, this may apply to all of the blades.

In exemplary embodiments, the control member may comprise a core arranged to push the blades outward, for example, by coming to bear against the enlarged portion.

In exemplary embodiments, the core and the ring may be made as a single piece, for example, by injection molding a plastics material.

In exemplary embodiments, the core may include an enlarged head, which may include a tapering portion sloping inward and toward a distal end of the core. At a periphery thereof, the head may also include longitudinal furrows.

In exemplary embodiments, at least one branch, and preferably two branches, may connect the ring to the core. The curler may include a base, and each branch may be arranged to slide in a respective longitudinal slot formed in the base.

In exemplary embodiments, the device may include a resilient return element arranged to return the control member toward a position in which the control member urges the curler to pass into the first configuration. The resilient return element may comprise a helical spring, for example, and may be housed at least in part in the handle member.

In exemplary embodiments, the device may also include an elastically-deformable member that tends to bring the curler into the second configuration. The elastically-deformable member may be annular in shape and may surround the blades. The elastically-deformable member may, for example, be engaged in a groove formed in radially outer surfaces of the blades.

In the first configuration, the curler may have a shape that is generally cylindrical about the longitudinal axis, while, in the second configuration, the curler may have a shape of transverse dimensions that decrease in a direction toward a free end of the curler. For example, the curler may be generally frustoconical in shape, converging in a direction away from the handle member when in the second configuration.

Exemplary embodiments of the invention may provide a method for rolling up at least one lock of hair using the device as defined above, the method comprising:

rolling a lock of hair around the curler while in the first configuration; applying a substance to the lock of hair as rolled up on the curler; bringing the curler into the second configuration by acting on the control member; and extracting the curler from the lock of hair.

In exemplary embodiments, the lock of hair may be rolled up on the curler by rotating the curler about the longitudinal axis.

In such a method, the same device may be advantageously reused to roll up another lock of hair.

For example, the substance applied to the hair may have a viscosity that increases or that solidifies on being put into contact with water. In exemplary embodiments, the curler may be extracted from the lock of hair, for example, less than thirty seconds after the substance has been applied to the lock of hair.

BRIEF DESCRIPTION OF THE DRAWINGS

The invention will be better understood on reading the following detailed description of non-limiting embodiments thereof, and on examining the accompanying drawings, in which:

FIG. 3 is a fragmentary and diagrammatic longitudinal cross-sectional view of the device as shown in FIG. 1;

FIG. 4 is an end view taken along arrow IV in FIG. 3;

FIG. 5 is a diagrammatic and fragmentary longitudinal cross-sectional view of the device as shown in FIG. 2;

FIG. 6 is an end view taken along VI in FIG. 5; and

DETAILED DESCRIPTION OF EMBODIMENTS

The exemplary device 1 shown in the figures may comprise a deformable curler 2 extending along a longitudinal axis X, the curler 2 being connected to a handle member which, in the example shown, may be in the form of a rod 3 extending longitudinally along the same axis X.

Figure 1:
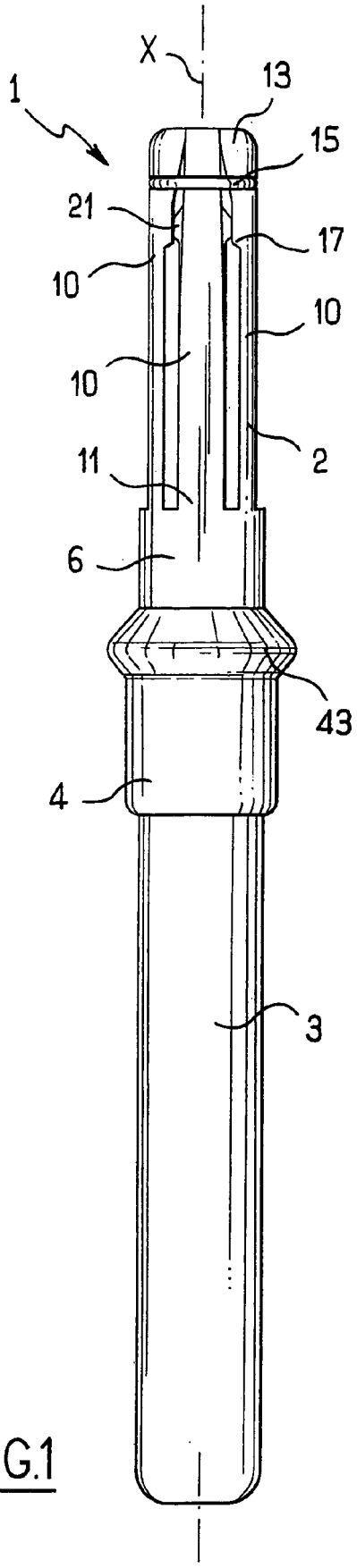
FIG. 1 is an elevation view of an exemplary device with the curler in a first configuration.
Figure 2:
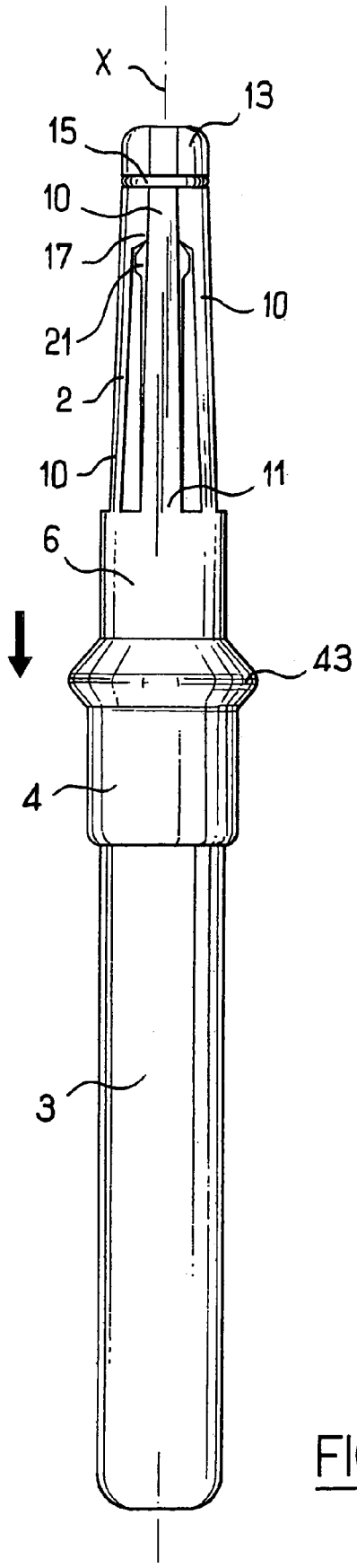
FIG. 2 is a view analogous to FIG. 1, with the curler in a second configuration.

A control member, which may be in the form of a ring 4 arranged to slide along the axis X, may enable a user to actuate the curler 2 to cause the curler to pass from a first configuration shown in FIG. 1, in which the curler 2 is generally cylindrical about the axis X, to a second configuration shown in FIG. 2, in which the curler 2 is substantially frustoconical in shape, converging away from the handle 3.

On the outside, the ring 4 may include a portion in relief 43 that may make it easier for the user to move the ring 4.

As shown in FIGS. 3 and 5, the handle 3 may include a threaded skirt 5 and the curler 2 may include a base 6 that is arranged to screw onto said threaded skirt 5.

The ring 4 may cover the skirt 5, as shown.

The curler 2 may comprise a plurality of flexible blades 10, for example, six blades as shown. The blades 10 may be connected at proximal ends 11 thereof to the base 6. The blades 10 may be made integrally by being molded out of a same plastics material as the base 6.

In the exemplary embodiment shown, an annular groove 12 may be formed in the outside surface of the blades 10 close to distal ends 13 thereof. The groove 12 may serve to receive an elastic band 15 that urges the blades 10 toward the second configuration shown in FIG. 5.

Each of the blades 10 may include an enlarged portion 17 projecting radially inward close to the distal end 13. The enlarged portion 17 may be arranged to co-operate with a moving core 20 that includes an enlarged head 21 at a distal end thereof.

The enlarged portion 17 and an inside face 24 of the corresponding blade 10 together may form a step 23.

The head 21 may include a tapering end portion 27 that is connected to a peripheral portion 28 that, in the exemplary embodiment shown, may include longitudinal furrows 40. The step 23 may slope in a same direction as the tapering portion 27 of the core 20.

When the curler 2 is in the first configuration, the enlarged portions 17 of the blades 10 may extend distally relative to the step 23 and may rest against the head 21 so that the blades 10 are spaced apart from one another. The elastic band 15 may be under tension. Outside faces 42 of the blades 10 may be substantially parallel to the axis X.

When the curler 2 is in the second configuration, the enlarged portions 17 may come to press against one another under a return effect of the elastic band 15 and the tapering end portion 27 of the head 21 may rest against the steps 23 of the blades 10.

In the exemplary embodiment shown, the core 20 may be connected to the ring 4 via at least two branches 30, which may be engaged in corresponding slots 31 of the base 6. These slots 31 may open to an edge of the base 6 that is adjacent to the handle 3, thus enabling the core 20 to be put into place between the blades 10 and enabling the branches 30 to be engaged in the slots 31.

The handle 3 may include a housing 34 that receives a helical spring 35 with one end bearing against an end 36 of the housing 34 and an opposite end bearing against the branches 30.

To assemble the device 1, the elastic band 15 may be put into place on the blades 10. The core 20 may be inserted into the curler 2. The spring 35 may be inserted into the handle 3. Then, the curler 2 may be screwed onto the handle 3.

The exemplary device 1 may be used as follows.

Figures 7A, 7B, 7C, 7D, 7E:
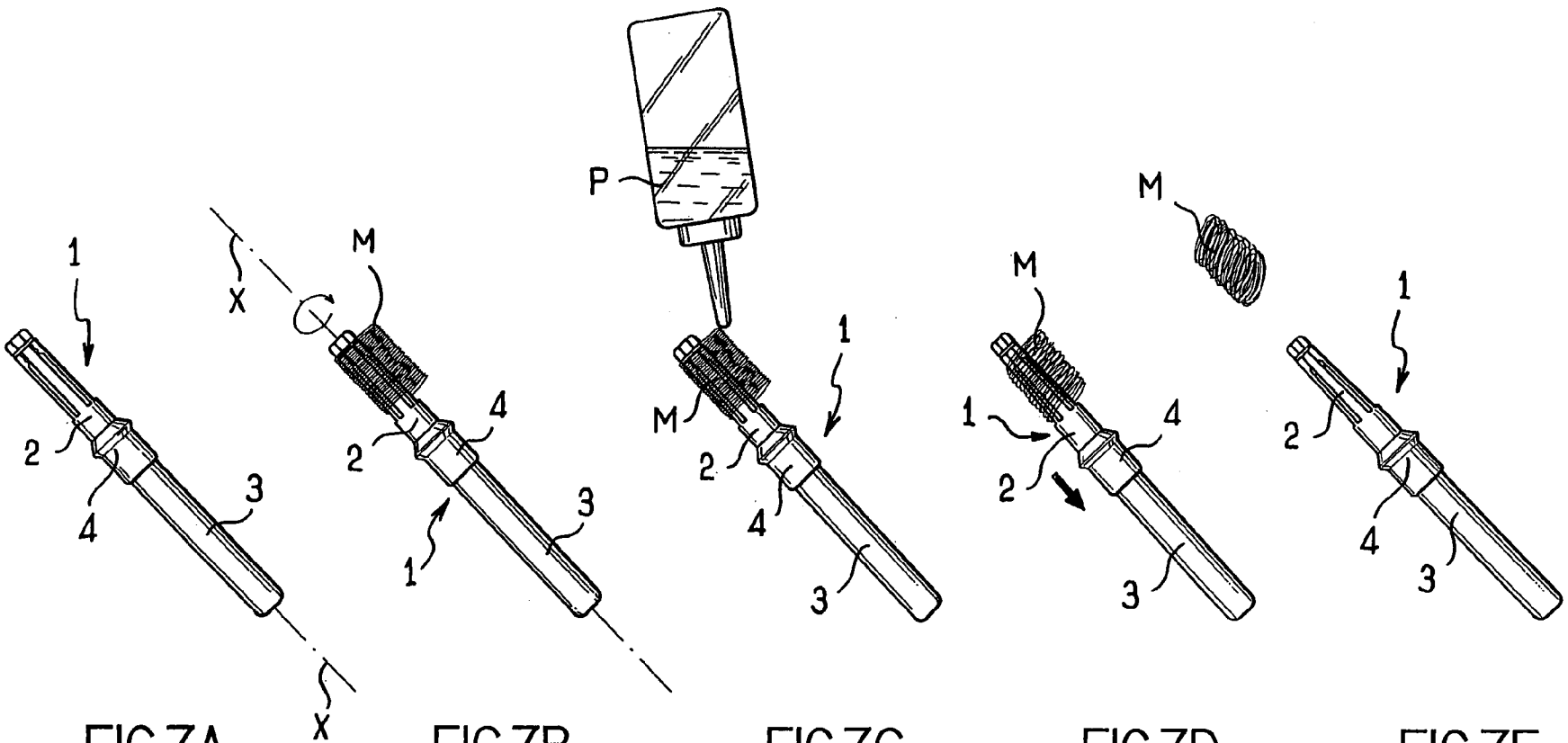
FIGS. 7A to 7E illustrate how the device may be used.

It is assumed that the curler 2 is in the first configuration as shown in FIG. 7A. In the first configuration, the head 21 may rub against the inside faces of the blades 10, and the longitudinal furrows 40 may prevent the blades 10 from skidding on the core 20.

The user may roll up a lock M of wet hair by turning the curler 2 about the longitudinal axis X, as shown in FIG. 7B. Curler paper may be used, where appropriate or desired.

As shown in FIG. 7C, the user may apply a permanent wave substance P on the rolled-up lock of hair. The substance P may have a property, for example, of solidifying or increasing in viscosity when coming into contact with water. The substance may be poured onto the surface of the lock and may also penetrate into the internal portion of the roll of hair via the gap between the blades 10.

The lock M may be held rolled on the curler 2 for a time required for the substance P to act, which may require a few seconds, after which the user may pull on the ring 4 to withdraw the head 21 of the core 20 against the return action of the spring 35, as shown in FIG. 7D. The blades 10 may then retract under the effect of the clamping force exerted by the elastic band 15 and the curler 2 may take up the generally tapering shape shown in FIG. 5. With the curler 2 in the second configuration, it is easier to extract the curler 2 from the lock of hair M without spoiling the curl, as shown in FIG. 7E. These various steps may be repeated with a new lock of hair as desired.

Naturally, the invention is not limited to the embodiments described above.

The curler 2 may be secured to the handle 3 other than by screw-fastening. For example, the curler 2 may be secured to the handle 3 by snap-fastening.

The blades 10 may also be made in some other way. For example, the elastic band 5 may be replaced by a dual-injected elastomer material.

The control member may also be made differently. For example, movement thereof relative to the curler 2 may be other than movement in pure translation.

The elastic band 15 may also be eliminated by shaping the blades 10 so that, at rest, the blades 10 slope toward the inside.

Throughout the description, including in the claims, the term "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device for rolling a lock of hair, the device comprising:

a deformable curler extending along a longitudinal axis, arranged to take up a first configuration that enables a lock of hair to be rolled up on the curler, and to take up a second configuration in which at least a fraction of a length of the curler has a radial dimension that is smaller than in the first configuration so as to facilitate extraction of the curler from the lock of hair rolled up on the curler in the first configuration, the curler including a plurality of blades;

a control member arranged to change the curler from the first configuration to the second configuration; and an elastically-deformable member that tends to return the curler into the second configuration, the elastically deformable member being annular in shape and surrounding the blades.

2. A device according to claim 1, further comprising a handle member to which the curler is connected.

3. A device according to claim 2, wherein the curler is releasably connected to the handle member.

4. A device according to claim 3, wherein the handle member and the curler co-operate by screw-fastening.

5. A device according to claim 2, wherein the curler, when in the second configuration, has a shape of transverse dimensions that decrease in a direction toward a free end of the curler.

6. A device according to claim 5, wherein the curler, when in the second configuration has a shape that is generally frustoconical in shape, converging in a direction away from the handle member.

7. A device according to claim 1, wherein the control member is movable relative to the curler.

8. A device according to claim 7, wherein the control member is movable relative to the curler along the longitudinal axis thereof.

9. A device according to claim 1, wherein the control member comprises a sliding ring.

10. A device according to claim 9, wherein the ring includes a portion in relief on an outside thereof that facilitates movement of the ring by a user.

11. A device according to claim 9, wherein at least two branches connect the ring to the core.

12. A device according to claim 1, wherein the blades are elastically deformable.

13. A device according to claim 1, wherein the blades are interconnected at proximal ends thereof.

14. A device according to claim 1, wherein at least one of the blades comprises an inwardly-projecting enlarged portion in a vicinity of a distal end thereof.

15. A device according to claim 1, wherein the control member comprises a core arranged to push the blades outward.

16. A device according to claim 15, wherein the control member further comprises a sliding ring and at least one branch connects the ring to the core.

17. A device according to claim 16, wherein the curler comprises a base, and wherein each branch is arranged to slide in a longitudinal slot in the base.

18. A device according to claim 15, wherein the control member further comprises a sliding ring, and wherein the core and the ring are made as a single piece.

19. A device according to claim 18, wherein the ring is made as a single piece by injection molding a plastics material.

20. A device according to claim 18, wherein the core comprises an enlarged head.

21. A device according to claim 20, wherein the head comprises a frustoconical portion that slopes inward and toward a distal end of the core.

22. A device according to claim 20, wherein the head comprises longitudinal furrows at a periphery thereof.

23. A device according to claim 1, further comprising a resilient return element arranged to return the control member into a position urging the curler to take up the first configuration.

24. A device according to claim 23, wherein the resilient return element comprises a helical spring.

25. A device according to claim 24, further comprising a handle member to which the curler is connected, the resilient return element being received at least in part in the handle member.

26. A device according to claim 1, wherein the elastically-deformable member is engaged in a groove formed in radially-outside surfaces of the blades.

27. A device according to claim 1, wherein the curler, when in the first configuration, has a shape that is generally cylindrical along the longitudinal axis.

28. A device according to claim 1, wherein the curler, when in the second configuration, has a part with a radial dimension that is smaller than in the first configuration, the part not being a central region of the curler.

29. A device according to claim 1, wherein the radial dimension is smaller in the second configuration than in the first configuration so as to facilitate sliding of the curler from the lock of hair along the longitudinal axis.

30. A method of rolling up a lock of hair using the device as defined in claim 1, the method comprising:

rolling a lock of hair around the curler while the curler is in the first configuration;

applying a substance to the lock of hair as rolled up on the curler;

bringing the curler into the second configuration by acting on the control member; and extracting the curler from the lock of hair.

31. A method according to claim 30, further comprising reusing the same device to roll up another lock of hair.

32. A method according to claim 30, wherein the substance has a viscosity that at least one of increases and solidifies when put into contact with water.

33. A method according to claim 30, wherein rolling the lock of hair up on the curler comprises revolving the curler about the longitudinal axis.

34. A method according to claim 30, wherein extracting the curler from the lock of hair is executed less than thirty seconds after applying the substance to the lock of hair.

* * * * *